US007152663B2

(12) United States Patent
Helin et al.

(10) Patent No.: US 7,152,663 B2
(45) Date of Patent: Dec. 26, 2006

(54) PLATE HEAT EXCHANGER

(75) Inventors: Per-Ola Magnus Helin, Ronneby (SE); Magnus Bror Nilsson, Dalby (SE); Claes Stenhede, Verona (IT)

(73) Assignee: Alfa Laval Corporate AB, Lund (SE)

( * ) Notice: Subject to any disclaimer, the term of this patent is extended or adjusted under 35 U.S.C. 154(b) by 411 days.

(21) Appl. No.: 10/467,353

(22) PCT Filed: Feb. 19, 2002

(86) PCT No.: PCT/SE02/00286

§ 371 (c)(1),
(2), (4) Date: Jan. 16, 2004

(87) PCT Pub. No.: WO02/070976

PCT Pub. Date: Sep. 12, 2002

(65) Prior Publication Data

US 2004/0134637 A1 Jul. 15, 2004

(30) Foreign Application Priority Data

Feb. 20, 2001 (SE) ..... 0100570

(51) Int. Cl.
*B60H 1/00* (2006.01)

(52) U.S. Cl. ..... 165/11.1; 165/299; 165/166

(58) Field of Classification Search ..... 165/299, 165/11.1, 166, 164, 167, 104.11
See application file for complete search history.

(56) References Cited

U.S. PATENT DOCUMENTS

| | | | | |
|---|---|---|---|---|
| 4,560,973 | A | 12/1985 | Grimm et al. | |
| 5,906,746 | A | 5/1999 | Helmo et al. | |
| 6,766,817 | B1 | 7/2004 | da Silva | |
| 2003/0034146 | A1* | 2/2003 | Kaufman | 165/11.1 |
| 2005/0178536 | A1* | 8/2005 | Blomgren et al. | 165/167 |

FOREIGN PATENT DOCUMENTS

| | | |
|---|---|---|
| DK | 96 00205 U3 | 10/1997 |
| EP | 0 608 195 | 7/1994 |
| GB | 617461 | 2/1949 |
| WO | 97/00415 | 1/1997 |

* cited by examiner

*Primary Examiner*—Ljiljana Ciric
(74) *Attorney, Agent, or Firm*—Fish & Richardson P.C.

(57) ABSTRACT

The invention refers to a plate heat exchanger, which includes a sensor device and a plate package of heat transfer plates (1). The heat transfer plates form between the plates (1) first passages (3) for a first fluid and second passages (4) for a second fluid. The sensor device includes a space (21), which is closed to the first passages (3) and the second passages (4). The closed space (21) is arranged to contain a medium, which can be influenced by the temperature of at least one of the fluids, and to be connectable to a device (14) for sensing a pressure change of the medium in the closed space (21). The closed space (21) is at least partly defined by at least one of the plates (1).

23 Claims, 4 Drawing Sheets

PLATE HEAT EXCHANGER

BACKGROUND OF THE INVENTION AND PRIOR ART

The present invention refers to a plate heat exchanger, which includes a sensor device and a plate package of heat transfer plates, which are provided to form, between the plates, first passages for a first fluid and second passages for a second fluid, wherein the sensor device includes a space, which is closed to the first passages and the second passages, wherein the closed space is arranged to contain a medium, which is provided to be influenced by the temperature of at least one of said fluids, and to be connectable to means for sensing a pressure change of said medium in the closed space.

EP-B-608 195 discloses such a plate heat exchanger with a sensor device, which includes a temperature sensor with an elongated shape. The temperature sensor extends in one of the porthole channels of the plate heat exchanger, which communicates with some of the heat transfer passages of the plate package. The temperature sensor communicates via a so-called capillary tube having a valve for controlling a flow of district heating water, for instance, through the plate heat exchanger.

WO97/00415 discloses a plate heat exchanger which is intended to be used as an oil cooler. The heat exchanger includes a valve, which is influenced by a sensor of another type, namely a temperature sensitive spring, which is mounted in a housing at a porthole channel of the heat exchanger. The valve opens and closes a bypass channel in the heat exchanger.

DK-U-9600205 discloses a plate heat exchanger, which is provided with a space arranged outside the plate heat exchanger and extending at an outer surface of the plate heat exchanger. An elongated temperature sensor is provided in the space. The space communicates with passages for one of the fluids in the plate heat exchanger. The space is provided in the proximity of one inlet or outlet opening of the heat exchanger. The temperature sensor is arranged to co-operate with equipment for controlling a flow of one of the fluids through the plate heat exchanger.

Each of these documents thus proposes the provision of a separate sensor outside the plate heat exchanger or in any of the porthole channels of the plate heat exchanger. The provision of such a separate sensor is difficult from a manufacturing point of view. Furthermore, a sensor in any of the porthole channels results in an increased flow resistance, not only due to the sensor proper but also due to the components required for attaching the sensor in the porthole channel. The known arrangements also have the disadvantage that the time constant is long, i.e. it takes a relatively long time before a temperature change of one or both fluids results in a sufficient influence on said medium and thus in a desired change of a valve position, for instance.

SUMMARY OF THE INVENTION

The object of the present invention is to overcome the problems mentioned above and to provide a plate heat exchanger with an improved sensor device, which can be manufactured in an easy manner.

This object is achieved by the plate heat exchanger initially defined, which is characterised in that the closed space at least partly is defined by at least one of said plates. In such a way, the closed space may be provided in very close, heat-transferring contact with one of said fluids. In such a way, the possibilities are created for obtaining a large contact surface of the sensor device. By such a large contact surface a significant driving force is obtained for said sensing means, for instance a control valve, the valve position of which is controlled by means of said medium. Moreover, by the sensor device according to the invention a small time constant and a short dead time are obtained, i.e. a very quick reaction to changes of the temperature of any of the fluids is thus obtained. Consequently, the sensor device according to the invention is not to any part provided in the porthole channels of the plate heat exchanger and will not form any flow obstruction. Advantageously, the closed space is at least partly defined by at least two of said plates. According to the invention, the closed space does not require any additional casing or the like, but it may be defined merely by a number of the plates included in the plate package. In applications where the temperature of the second fluid is to be controlled at the same time as the flow of the second fluid approaches zero, which is a typical situation in a tap water application, it is an advantage that the sensor device according to the invention is positioned within the plate heat exchanger and thus is quickly influenced by temperature changes. Then the sensor device transmits quickly a signal to a control valve, for instance, that it is to be closed, wherein the flow of the first fluid quickly will be stopped. This means that as little energy as possible will be stored in the heat exchanger, and thus raised temperatures resulting in risks of scalding and lime deposits are avoided. At the same time the return temperature of the first fluid is kept down and the flow quantity passing through the first passages will be the smallest possible.

According to a further embodiment of the invention, the closed space is positioned in such a way that it is in heat-transferring contact with one of said first fluid and said second fluid. The closed space may also be positioned in such a way that it is in heat-transferring contact with said first fluid and said second fluid. Such an application, where the sensor device senses both fluids, is advantageous in automative control systems, i.e. such systems that are driven by means of energy from the process to be controlled. Such systems have a property, which always result in a certain control deviation, which in for instance electrical control systems can be removed by means of an integrating function. In a tap water application, where the sensor device according to conventional technique senses the temperature on the secondary side, i.e. of the second fluid, the negative influence of the control deviation increases if the load increases. If the temperature on the primary side, i.e. in the first fluid, is too high, the control deviation will be positive. By letting the sensor device sensing both the first fluid and the second fluid, one may compensate for the control deviation contributed to by the primary temperature.

According to a further embodiment of the invention, said two plates form a first limiting plate and a second limiting plate. Then the first limiting plate and the second limiting plate may be provided in such a way in relation to the plate package that one of said passages extend between the first limiting plate and one of said heat transfer plates. In such a way, a very large contact surface between the space and one or both of said passages is obtained. The first limiting plate may then be in heat-transferring contact with one of said fluids.

According to an embodiment of the invention, another one of said passages extends between the second limiting plate and another one of said heat transfer plates. In such a way, the closed space will be provided in the plate heat exchanger proper and the contact surface towards said passages may be doubled. The first limiting plate may thus be in heat-transferring contact with the second fluid and the second limiting plate may be in heat-transferring contact with the first fluid. However, it is within the scope of the invention also possible to let both the first limiting plate and the second limiting plate be in heat-transferring contact with merely one of said fluids.

According to a further embodiment of the invention, at least the first limiting plate is formed by one of said heat transfer plates, which is shaped in such a way that it together with the second limiting plate forms the closed space. In such a way, a solution which is interesting from a manufacturing point of view is obtained. The closed space may be formed by the components normally included in a plate heat exchanger. No sensor member defining a closed space thus needs to be introduced into the plate heat exchanger. Advantageously, also the second limiting plate may be formed by one of said heat transfer plates, wherein these two heat transfer plates are shaped in such a way that they together form the closed space.

According to a further embodiment of the invention, the closed space has a length and a width in one plane, which is substantially in parallel with an extension plane of said heat transfer plates, and a depth in one direction, which is perpendicular to said plane, wherein at least said length is substantially larger than said depth. Advantageously, also said width is substantially larger than said depth. In such a way, a large contact surface of the closed space towards one or several of said fluids is ensured.

According to a further embodiment of the invention, the closed space extends through at least one of said plates. In such a way, the closed space may be positioned in an area of the plate heat exchanger where at least one of the fluids has a significant temperature. Consequently, this substantial temperature may be utilised for controlling the flow of at least one of said fluids through the plate heat exchanger. Advantageously, the closed space may extend through substantially all of said plates.

According to a further embodiment of the invention, said plates, through which the closed space extends, have a respective hole, which is surrounded by an edge portion shaped in such a way that it abuts sealingly an adjacent one of said plates.

According to a further embodiment of the invention, said plates are permanently connected to each other, for instance by brazing or gluing.

According to a further embodiment of the invention, the device includes a conduit, which extends from the closed space to said means for sensing a pressure change. Furthermore, said means for sensing a pressure change may advantageously include a valve for influencing the flow of one of said fluids through the plate heat exchanger.

According to a further embodiment of the invention, the plate heat exchanger includes a first inlet porthole channel, which extends through the heat transfer plates and is arranged to transport the first fluid into the plate heat exchanger to the first passages, a first outlet porthole channel, which extends through the heat transfer plates and is arranged to transport the first fluid out from the plate heat exchanger from the first passages, a second inlet porthole channel, which extends through the heat transfer plates and is arranged to transport the second fluid into the plate heat exchanger to the second passages, and a second outlet porthole channel, which extends through the heat transfer plates and is arranged to transport the second fluid out from the plate heat exchanger from the second passages.

BRIEF DESCRIPTION OF THE DRAWINGS

The present invention is now to be explained more closely by a description of different embodiments disclosed by way of example and with reference to the drawings attached.

DETAILED DESCRIPTION OF VARIOUS EMBODIMENTS OF THE INVENTION

Figure 1:
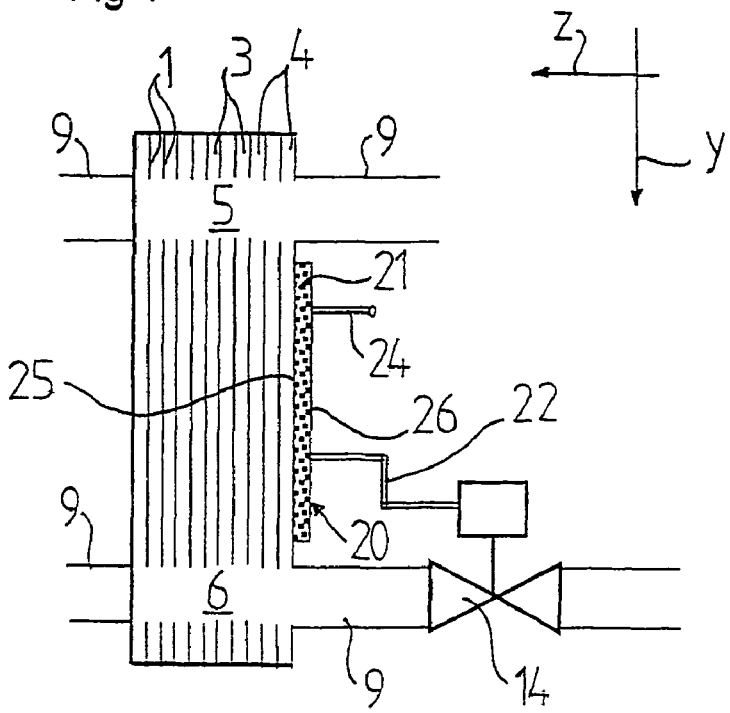
FIG. 1 discloses schematically a sectional side view of a plate heat exchanger according to a first embodiment.
Figure 2:
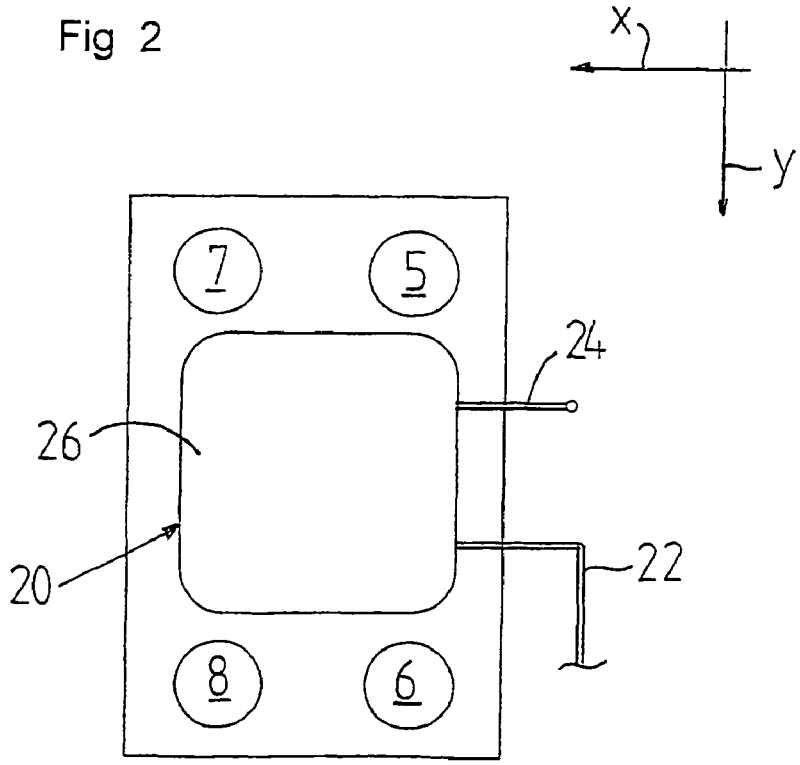
FIG. 2 discloses another side view of the plate heat exchanger in FIG. 1.

FIGS. 1 and 2 disclose a plate heat exchanger according to a first embodiment of the invention. The plate heat exchanger includes a number of heat transfer plates 1, which form a plate package. The heat transfer plates 1 are pressed to such a shape that, when they are arranged beside each other to said plate package, a plate interspace is formed between each pair of plates 1. The plate interspaces are arranged to form first passages 3 for a first fluid and second passages 4 for a second fluid. The first passages 3 are separated from the second passages 4.

Furthermore, the plate heat exchanger includes four porthole channels 5, 6, 7, 8, which extend through all plates 1, wherein two of the porthole channels communicate with the first passages 3 and two of the porthole channels communicate with the second passages 4. It is to be noted that the plate heat exchanger according to the invention also may be of a type, which has 2 or 6 porthole channels. Each porthole channel 5–8 is formed by an opening or porthole in each plate 1 and connected to a pipe 9, which extends from the plate package. More specifically, the porthole channels 5–8 form a first inlet porthole channel 5, which is arranged to transport the first fluid to the first passages 3, a first outlet porthole channel 6, which is arranged to transport the first fluid out from the plate heat exchanger from the first passages 3, a second inlet porthole channel 7, which is arranged to transport the second fluid to the second passages 4, and a second outlet porthole channel 8, which is arranged to transport the second fluid out from the plate heat exchanger from the second passages 4.

Figure 4:
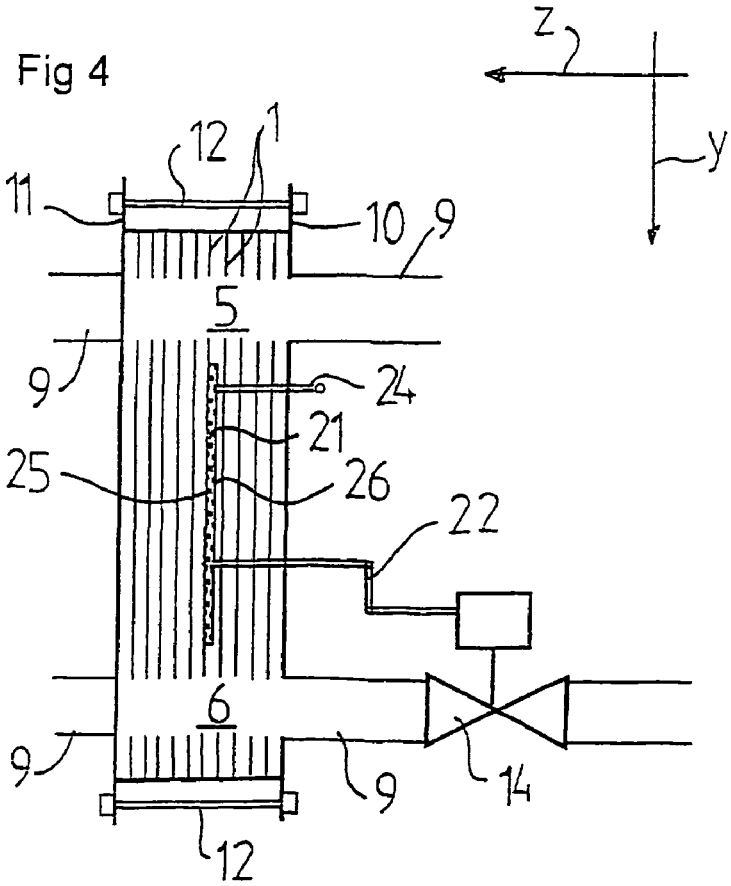
FIG. 4 discloses schematically a sectional side view of a plate heat exchanger according to a third embodiment.

In the plate heat exchanger disclosed in FIGS. 1 and 2, the plates 1 are permanently connected to each other by brazing. The plate heat exchanger according to the invention may, however, be manufactured according to any assembling method suitable for connecting or compressing together a number of heat transfer plates 1 to a plate package, for instance gluing, welding or being partly assembled through brazing. In FIG. 4 a plate heat exchanger is disclosed, where the plates 1 are pressed against each other between two end plates 10 and 11 by means of bolts 12. Gaskets may then be provided between the plates 1 for separating said passages 3 and 4 from each other.

The plate heat exchanger also includes a control valve 14, which in the embodiments disclosed is provided on the pipe 9, which connects to the first outlet porthole channel 6. By means of this control valve 14, the flow of the first fluid through the plate heat exchanger may thus be controlled.

A sensor device is provided in or at the plate heat exchanger in order to sense the temperature of one of or both the first and the second fluids. The sensor device includes a sensor 20 forming a closed space 21. The closed space 21 contains a medium which can be influenced by the temperature of at least one of the first fluid and the second fluid. This medium may for instance include a solid substance and a gas, for instance carbon plus carbon dioxide, merely a liquid or a mixture of a liquid and a gas.

The closed space 21 is connected to means for sensing a pressure change of said medium via a conduit 22, a so-called capillary tube, which extends from the closed space 21 to said means. In the embodiment disclosed, said means includes a control valve 14. The control valve 14 may then include a membrane controlling the movement of a valve body in the control valve 14 and sensing the pressure changes of said medium in a manner known per se. The control valve 14 may also include pressure sensitive members of another type, for instance a piezoelectric element for forming an electric signal which may be utilised as a control signal for adjusting the valve position. The invention is not limited to the control valve 14 disclosed but said means may, as a supplement or an alternative, include monitoring equipment and/or any other control equipment. Of course, the pressure change obtained in the medium may be used for controlling the flow of all fluids flowing through the plate heat exchanger.

In order to enable filling of said medium to the closed space 21, a connecting pipe 24 is provided. The connecting pipe 24, which is openable, extends into the closed space 21.

The closed space 21 is defined at least partly by a first limiting plate 25 and a second limiting plate 26. The two limiting plates 25 and 26 are permanently connected to each other, for instance by brazing, gluing or the like. In the embodiment disclosed in FIGS. 1 and 2, the first limiting plate 25 is formed by the outermost heat transfer plate 1 and the second limiting plate 26 by a plate lying outside the outermost heat transfer plate 1. The two limiting plates 25, 26 may be formed by a respective heat transfer plate, which during the pressing operation has been given such a shape that they during the assembling of the plate package form the closed space 21 between each other. In the embodiment disclosed in FIG. 1, the first limiting plate 26 will thus adjoin one of the second passages 4 and thus be in direct heat-transferring contact with the second fluid. The pressure of said fluid thus depends on the temperature of the first fluid. Of course, the limiting plate 25 may as an alternative adjoin one of the first passages 3.

Figure 3:
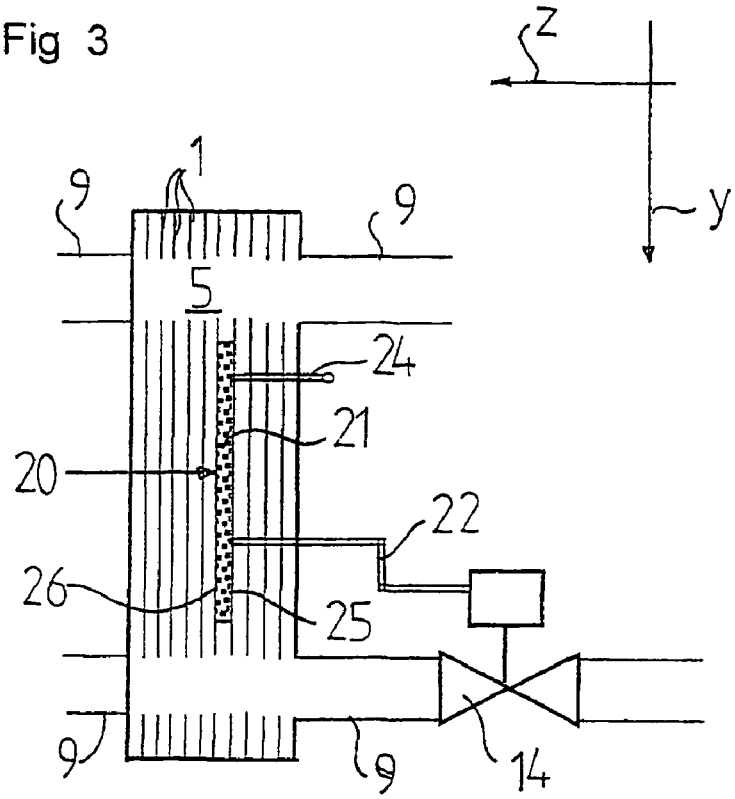
FIG. 3 discloses schematically a sectional side view of a plate heat exchanger according to a second embodiment.

In the embodiment disclosed in FIG. 3, both the limiting plates 25 and 26 are provided in the plate package proper and formed by a respective heat transfer plate 1, which during the pressing of the plates 1 has been given such a shape that they upon the assembling of the plate package completely form the closed space 21 between each other. In the embodiment disclosed in FIG. 3, the first limiting plate 25 adjoins one of the second passages 4 and the second limiting plate 26 one of the first passages 3. The first limiting plate 25 is thus in direct heat-transferring contact with the second fluid and the second limiting plate 26 is in direct heat-transferring contact with the first fluid. The pressure of said medium depends in this embodiment on the temperature of both the first fluid and the second fluid.

It is of course, within the scope of invention, possible to design the plates 1, 25, 26 in such a way that the first limiting plate 25 and the second limiting plate 26 adjoin a respective one of said first passages 3 or alternatively one of said second passages 4. In such a way, both the limiting plates 25, 26 will be in direct heat-transferring contact with one of said fluids. The pressure of said medium will thus depend on the temperature of this fluid.

In the embodiment disclosed in FIG. 4, one of the limiting plates 26 is provided in one of the passages 3 and 4, in the example disclosed one of the second passages 4. The limiting plate 26 is thus in direct heat-transferring contact with the second medium. In this embodiment, the limiting plate 26 is permanently connected to the most closely positioned heat transfer plate 1, which forms the limiting plate 25.

The closed space 21 has a length a and width b in a plane x, y which is substantially in parallel with an extension plane of the heat transfer plates 1, and a depth c in a direction z, which is perpendicular to the plane x, y. As appears from the embodiments disclosed, the length a and the width b are substantially larger than the depth c. In the embodiments disclosed, both the length a and the width b have a size in an order approaching the active heat-transferring surface of the heat transfer plates 1. The contact surface of the limiting plates 25, 26 towards the respective fluid is thus substantially larger than the contact surface of the temperature sensors disclosed in the documents initially mentioned.

In the embodiments disclosed in FIGS. 1–3, each passage has, in the direction z, a depth which is substantially equal to the depth c and thus also substantially smaller than the length a and the width b.

The sensor device according to the invention thus creates a very large contact surface towards one or several of the fluids flowing through the plate heat exchanger. In such a way, a temperature sensor 20 is obtained, which has a very small time constant, i.e. it reacts very quickly on temperature changes of the fluid or the fluids.

Figure 5:
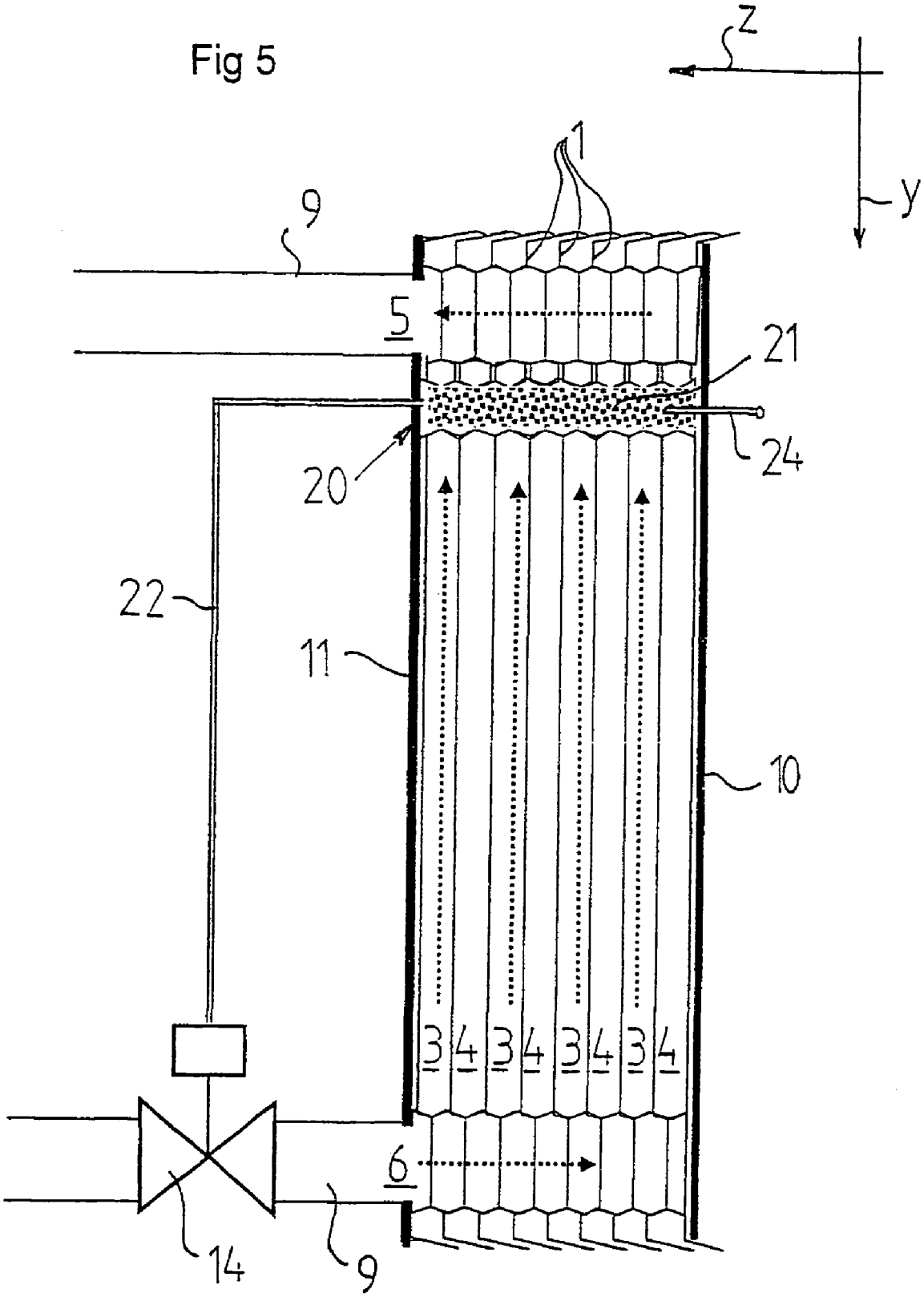
FIG. 5 discloses schematically a sectional view from outside of a plate heat exchanger according to a fourth embodiment.
Figure 6:
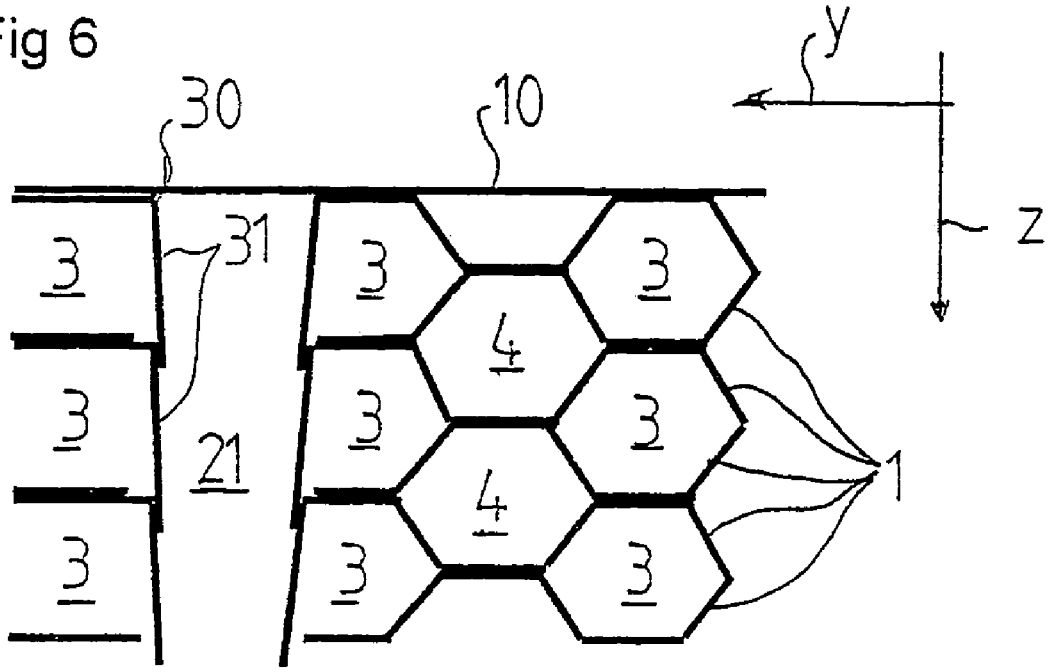
FIG. 6 discloses schematically a sectional view of a part of a plate heat exchanger according to a fourth embodiment.
Figure 7:
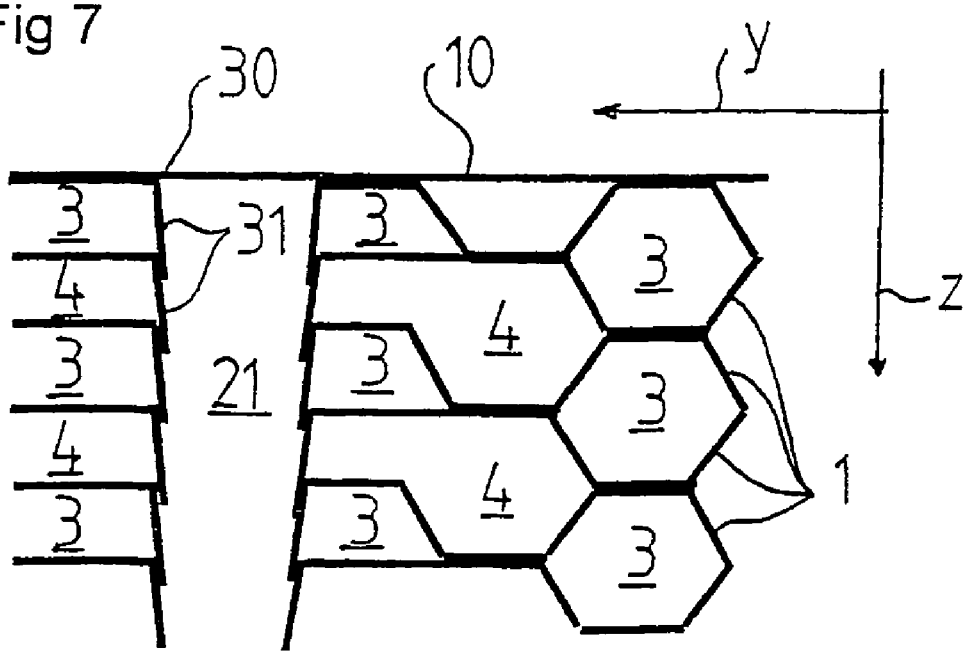
FIG. 7 discloses schematically a sectional view of a part of a plate heat exchanger according to the fourth embodiment.

FIGS. 5–7 disclose a fourth embodiment of the invention where the closed space 21 extends in the direction z, i.e. transversally through the heat transfer plates 1. In the embodiment disclosed in FIG. 5, the space 21 extends through all heat transfer plates 1 except for the end plates 10, 11. The closed space 21 is in this embodiment substantially completely defined merely by plates 1. Each plate 1 includes a hole, which is defined by an edge portion 30 extending around the hole. The edge portion 30 may be bent from the extension plane of the plate 1 and form a collar or flange 31 extending around the hole. The edge portions 30 and the flanges 31 are formed in such a way that they abut sealingly another plate 1. The edge portions 30 may thus be produced in connection with the manufacturing of the plate 1 by means of a pressing operation. The edge portion 30 and the flange 31 then form the edge on a depression and the hole may be made in the depression during the pressing operation proper or in a subsequent manufacturing step.

Depending on where the holes are positioned on the plate 1, it is possible to design the closed space 21 in such a way that it is in direct contact with the first passages 3 and the first fluid, see FIG. 6, or with the second passages 4 and the second fluid. The closed space 21 may also be positioned in such a way that the medium in the closed space 21 is in direct heat-transferring contact with both the first fluid in the first passages 3 and the second fluid in the second passages 4, see FIG. 7.

The invention is applicable within practically all areas where a plate heat exchanger is used. An important application is district heating systems, which include plate heat exchangers for receiving a first fluid from the district heating network and for heating of a second fluid for a consumer. Especially, the invention may then be utilised for heating of tap water, wherein the sensor device is arranged to control the flow of the first fluid from the district heating network in dependence on the temperature of the second fluid, i.e. the tap water to the consumers.

The invention is not limited to the embodiments disclosed but may be varied and modified within the scope of the following claims. For instance, it may be mentioned that the sensor device also may be provided in plate heat exchangers, which are arranged to receive more fluids than two, for instance three fluids, wherein the plates of the plate heat exchanger also form third passages which are separated from the first and second passages.

What is claimed is:

1. A plate heat exchanger comprising a sensor device and a plate package of heat transfer plates, said heat transfer plates forming therebetween a plurality of first passages for a first fluid and a plurality of second passages for a second fluid, wherein the sensor device includes a space which is closed to the first passages and to the second passages, said closed space being arranged to contain a medium, said medium being provided to be influenced by the temperature of at least one of said fluids, and to be connectable to means for sensing a pressure change of said medium in the closed space, wherein the closed space is at least partly defined by at least one of said heat transfer plates.

2. A plate heat exchanger according to claim 1, wherein the closed space is in heat transfer contact with one of said first fluid and said second fluid.

3. A plate heat exchanger according to claim 1, wherein the closed space is in heat transfer contact with said first fluid and said second fluid.

4. A plate heat exchanger according to claim 1, wherein the closed space is at least partly defined by at least two of said heat transfer plates.

5. A plate heat exchanger according to claim 4, wherein said at least two heat transfer plates form a first limiting plate and a second limiting plate.

6. A plate heat exchanger according to claim 5, wherein the first limiting plate and the second limiting plate are arranged in such a way in relation to the plate package that one of said passages extends between the first limiting plate and one of said heat transfer plates.

7. A plate heat exchanger according to claim 6, wherein the first limiting plate is in heat transfer contact with one of said fluids.

8. A plate heat exchanger according to claim 6, wherein another of said passages extends between the second limiting plate and another of said heat transfer plates.

9. A plate heat exchanger according to claim 8, wherein the first limiting plate is in heat transfer contact with the second fluid and the second limiting plate is in heat transfer contact with the first fluid.

10. A plate heat exchanger according to claim 8, wherein the first limiting plate and the second limiting plate both are in heat transfer contact with only one of said fluids.

11. A plate heat exchanger according to claim 6, wherein at least the first limiting plate is formed of one of said heat transfer plates, which is shaped in such a way that it together with the second limiting plate forms the closed space.

12. A plate heat exchanger according to claim 11, wherein the second limiting plate is formed by a second one of said heat transfer plates, wherein said two heat transfer plates are shaped in such a way that they together form the closed space.

13. A plate heat exchanger according to claim 6, wherein the closed space has a length (a) and a width (b) in a plane (x, y), said plane being substantially parallel to an extension plane of said heat transfer plates, and a depth (c) in a direction (z), which is perpendicular to said plane (x, y), wherein at least said length (a) is substantially larger than said depth (c).

14. A plate heat exchanger according to claim 13, wherein said width (b) is substantially larger than said depth (c).

15. A plate heat exchanger according to claim 13, wherein each of the passages has a depth in the direction (z), wherein at least said length (a) is substantially larger than the depth of one of said passages.

16. A plate heat exchanger according to claim 15, wherein said width (b) is substantially larger than the depth of one of said passages.

17. A plate heat exchanger according to claim 1, wherein the closed space extends through at least one of said heat transfer plates.

18. A plate heat exchanger according to claim 17, wherein the closed space extends through substantially all of said heat transfer plates.

19. A plate heat exchanger according to claim 17, wherein said heat transfer plates through which the closed space extends, each have a respective hole, surrounded by an edge portion, and formed in such a way that the edge portion abuts sealingly an adjacent one of said heat transfer plates.

20. A plate heat exchanger according to claim 1, wherein said heat transfer plates are permanently connected to each other.

21. A plate heat exchanger according to claim 1, wherein the sensor device includes a conduit, extending from the closed space to said means for sensing a pressure change.

22. A plate heat exchanger according to claim 21, wherein said means for sensing a pressure change includes a valve for influencing the flow of one of said fluids through the plate heat exchanger.

23. A plate heat exchanger according to claim 1, wherein the plate heat exchanger further comprises a first inlet porthole channel, extending through the heat transfer plates and arranged to transport the first fluid into the plate heat exchanger to the first passages, a first outlet porthole channel, extending through the heat transfer plates and arranged to transport the first fluid out from the plate heat exchanger from the first passages, a second inlet porthole channel, extending through the heat transfer plates and arranged to transport the second fluid into the plate heat exchanger to the second passages, and a second outlet porthole channel, extending through the heat transfer plates and arranged to transport the second fluid out from the plate heat exchanger from the second passages.

* * * * *